United States Patent [19]

Manente, Jr. et al.

[11] Patent Number: 4,470,754

[45] Date of Patent: Sep. 11, 1984

[54] PARTIALLY SEGMENTED SUPPORTING AND SEALING STRUCTURE FOR A GUIDE VANE ARRAY OF A GAS TURBINE ENGINE

[75] Inventors: Joseph C. Manente, Jr., Monroe; Horst D. Berkner, Stratford, both of Conn.

[73] Assignee: Avco Corporation, Stratford, Conn.

[21] Appl. No.: 396,176

[22] Filed: Jul. 7, 1982

Related U.S. Application Data

[63] Continuation of Ser. No. 151,047, May 19, 1980, abandoned.

[51] Int. Cl.[3] ..... F01D 5/02

[52] U.S. Cl. ..... 415/136; 415/134; 415/170 R; 415/173 R

[58] Field of Search ..... 415/134, 135, 136, 137, 415/138, 139, 170 R, 172 A, 172 R, 173 R, 95, 115

[56] References Cited

U.S. PATENT DOCUMENTS

| | | | |
|---|---|---|---|
| 2,609,176 | 9/1952 | Purvis | 415/138 |
| 2,651,496 | 9/1953 | Buckland | 415/135 |
| 2,772,069 | 11/1956 | Hocketert | 415/134 |
| 3,552,753 | 1/1971 | Mierley et al. | 415/115 |
| 3,829,233 | 8/1974 | Scalzo et al. | 415/175 |
| 3,947,145 | 3/1976 | Michel et al. | 415/138 |
| 4,113,406 | 9/1978 | Lee et al. | 416/95 |

*Primary Examiner*—Henry C. Yuen
*Assistant Examiner*—John Kwon
*Attorney, Agent, or Firm*—Ralph D. Gelling

[57] ABSTRACT

A nozzle of a gas turbine engine includes an array of radially extending guide vanes fixedly supported at their tip portions to an outer shroud, while the root portion of each vane is connected to a segment of a radially inner, segmented shroud. Each segment is, in turn, connected via a slip fit inter-connection to a radially inner ring support structure of generally L-shaped configuration. A spring extends between the segment and the base of the L-shaped ring support for forming a flexible coupling between the inner ring and the segment, while the remaining portion of the ring support structure defines a pressure dam to reduce leakage through the flexible coupling connection. The segmented nozzle construction effectively reduces stress levels resulting from differential thermal excursions of the components of the nozzle under transient and steady state operation of the engine, while also minimizing leakage through the flexible coupling.

1 Claim, 4 Drawing Figures

PARTIALLY SEGMENTED SUPPORTING AND SEALING STRUCTURE FOR A GUIDE VANE ARRAY OF A GAS TURBINE ENGINE

This is a continuation of application Ser. No. 151,047 filed May 19, 1980, now abandoned.

The Government has rights in this invention pursuant to Contract No. DAAK30-77-C-0006 awarded by the Department of the Army.

BACKGROUND OF THE INVENTION

The present invention relates to a turbine nozzle as employed in a multi-stage turbine of a gas turbine engine, and more particularly, a supporting and sealing structure for an array of radially extending guide vanes of a turbine nozzle wherein the root ends of the guide vanes are flexibly connected by a segmented inner shroud, and which supporting structure includes a pressure dam to minimize the amount of leakage introduced by providing flexibility in the nozzle assembly.

In a multi-stage turbine of a gas turbine engine, stationary vane assemblies are inserted between the rotor wheels, as well as at the entrance and exit of the turbine unit. In the operation of the gas turbine engine, the stationary vane assemblies function to alter the static pressure and change the velocity of the high pressure, high temperature gases flowing through the turbine. Heretofore, in order to insure the structural integrity of a vane assembly as it is subjected to thermal excursions of the components of the assembly during transient and steady state operating conditions of the gas turbine engine, it has been common to cast the entire nozzle assembly in one piece. The one piece assembly included an outer, unitary shroud, an inner, unitary shroud, and the array of radially extending guide vanes. With this prior art construction, it has been found that during transient and steady state operation of the gas turbine engine, the temperature differentials between the thin, fast responding vanes and the slower, more massive shroud rings, causes a differential thermal growth or thermal gradient to develop within the nozzle assembly, as well as different temperature levels throughout the nozzle assembly. The result of the differential thermal gradients causes differential thermal excursions of the parts of the nozzle assembly, thereby leading to the development of local stresses and cracks in the interconnections between the vanes and the shrouds. In addition, the inner shroud of a stationary turbine nozzle is usually sealed by a sheet metal member which is usually brazed to the inner shroud, and it has been found that the thermal excursions of the parts of the turbine nozzle have caused distortion and separation of the brazed connections due to the thermal loading on the sheet metal pieces, thereby resulting in pressure leakage through the vane assembly.

Accordingly, it is an object of the subject invention to overcome the shortcomings of the prior art turbine nozzle assemblies and to provide a new and improved supporting and sealing structure for an array of radially extending guide vanes of a nozzle of a gas turbine engine, which supporting and sealing structure provides a flexible coupling between the individual vanes and the inner shroud.

It is another object of the present invention to provide a new and improved supporting and sealing structure for an array of radially extending guide vanes of a gas turbine engine wherein the flexible coupling between the root ends of the vanes and the inner segmented shroud is sealed by a flexible, pressure dam to minimize leakage through the flexible coupling.

It is a further object of the present invention to provide a new and improved supporting and sealing structure for an array of radially extending guide vanes of a nozzle of a gas turbine engine including means for maintaining the radial and axial alignment of the vanes under transient and steady state operating conditions of the gas turbine engine.

SUMMARY OF THE INVENTION

The nozzle of the subject invention is embodied in a gas turbine engine, and includes a radially inner shroud ring, a radially outer shroud ring, and a plurality of radially extending vane structures respectively disposed between the radially inner and the radially outer shroud rings. Each vane is firmly secured at its tip end to the radially outer shroud ring, while the root end of each vane is secured to the inner shroud ring by an inner support and sealing structure. The latter includes a radially inner ring structure of generally L-shaped cross-section including a generally cylindrical base, and a radially outwardly extending disc. The root end of each vane is connected to a structural segment which forms a portion of a plurality of segments defining a segmented ring. Each structural segment includes a radially inwardly extending lug which is adapted to engage a cooperating slot which extends in two mutually perpendicular directions on the radially outwardly extending disc of the inner ring structure to define a slip fit connection. The latter functions to retain the inner support and sealing structure concentric to the outer shroud ring. The slip fit connection between the structural segments and the disc also functions to define a pressure dam for minimizing pressure leakage through the flexible coupling of the vanes to the inner shroud. A spring of generally C-shaped cross-section preferably extends between each segment and the base of the L-shaped inner ring structure, thereby providing a flexible restraining interconnection between the inner shroud and the vanes. The new and improved sealing and supporting structure of the subject invention provides flexibility in the nozzle assembly, thereby eliminating the development of local stresses within the nozzle assembly, while minimizing the amount of leakage introduced by providing flexibility in the nozzle assembly. The flexibility of the subject invention is obtained by the provision of the segmented inner shroud and the springs. The pressure dam is effective to reduce leakage, and by virtue of the slip fit interconnection between the structural segments and the disc portion of the inner ring structure, the pressure dam is maintained during thermal excursions of the components of the nozzle assembly, during both transient and steady state operating conditions of the turbine engine.

DESCRIPTION OF THE DRAWINGS

Other objects and advantages of the invention will become apparent from a reading of the following detailed description taken in conjunction with the drawings in which.

DETAILED DESCRIPTION OF THE PREFERRED EMBODIMENT

Figure 1:
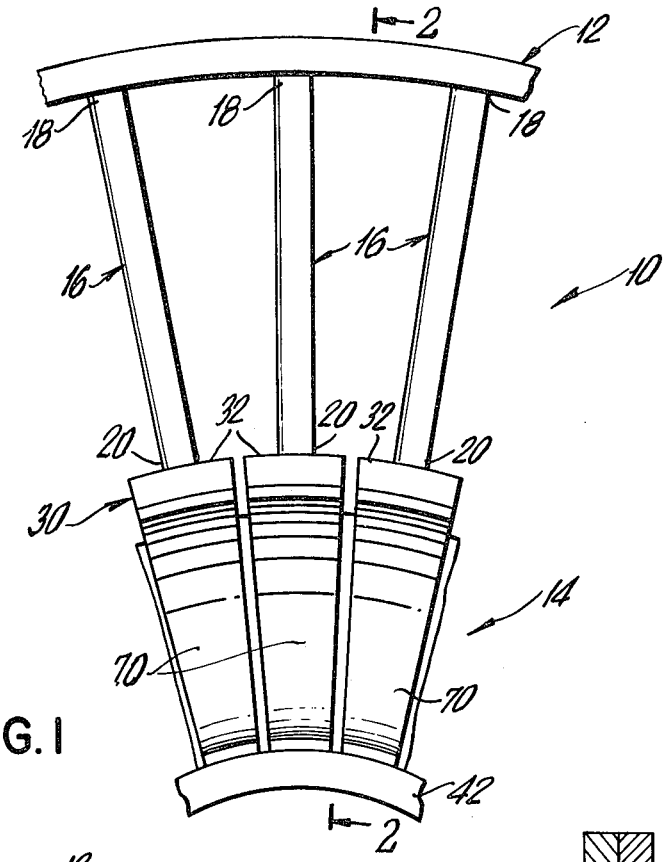
FIG. 1 is a front elevational view of the new and improved nozzle assembly of the subject invention.
Figure 2:
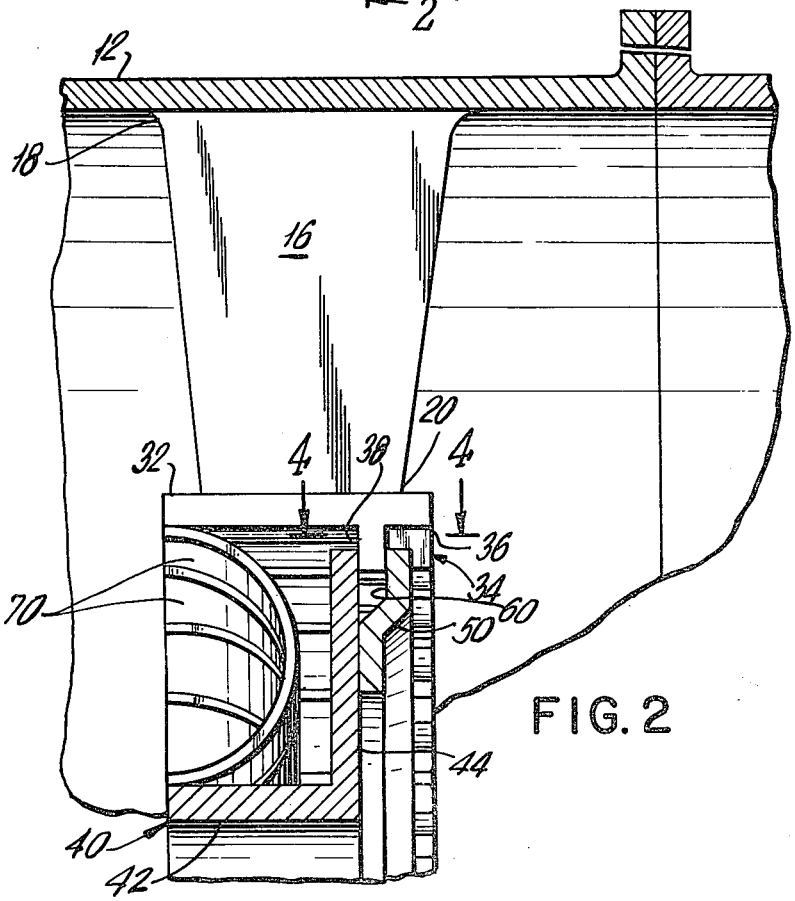
FIG. 2 is a cross-sectional view taken along line 2—2 in FIG. 1.
Figure 3:
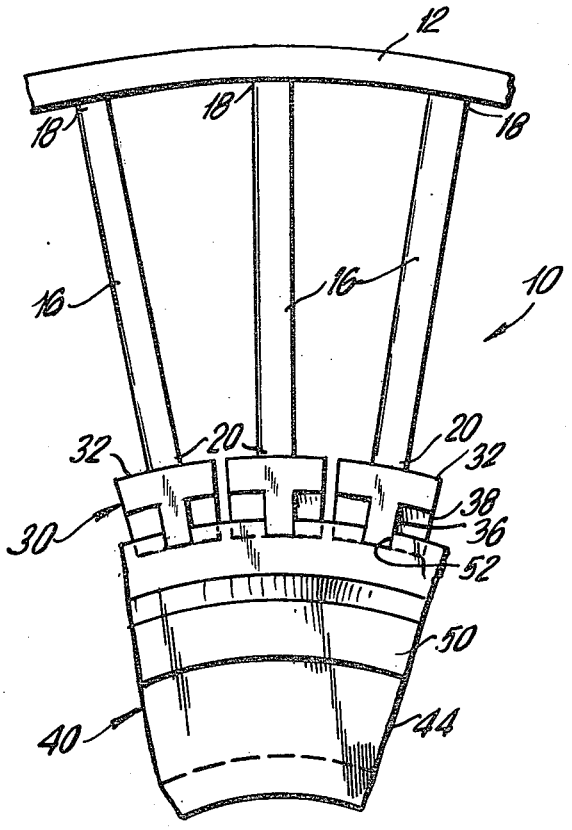
FIG. 3 is a rear elevational view of the new and improved nozzle assembly of the subject invention.

Referring to FIGS. 1, 2, and 3, the stationary turbine nozzle assembly of the subject invention is generally designated by the numeral 10 and basically comprises a radially outer shroud ring 12, a radially inner shroud ring 14, and an array of radially extending guide vanes 16 disposed between rings 12 and 14. The radially outer tip portions 18 of each guide vane 16 is secured to the inner surface of the outer shroud ring 12 by a rigid connection, such as by brazing or casting. On the other hand, the root portion 20 of each guide vane 16 is flexibly connected to the inner shroud by means of the supporting and sealing structure of the subject invention. The supporting and sealing structure enables the guide vanes 16 to undergo thermal excursions during transient and steady state operation of the gas turbine engine, without resulting in distortion or the development of local stresses on the assembly 10 which could lead to the development of local cracks in the assembly.

Figure 4:
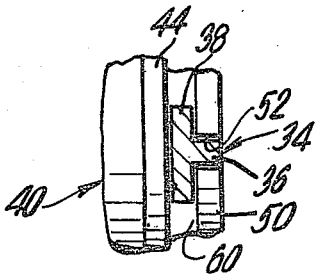
FIG. 4 is a cross-sectional view taken along line 4—4 in FIG. 2.

The supporting and sealing structure of the subject invention includes a segmented ring 30 which is defined by a plurality of individual segments 32 arranged concentrically with the radially outer shroud ring 12. Each segment 32 is connected to the root end 20 of a radially extending guide vane 16. As illustrated in FIGS. 2, 3, and 4, depending from each segment 32 and extending radially inward of the segment 32, is a T-shaped lug portion 34. Each T-shaped lug 34 includes a leg portion 36 which is aligned with the longitudinal axis of the gas turbine engine, and a transverse bar segment 38 extending orthagonal to the longitudinal axis of the engine. The supporting and sealing structure 40 further includes a radially inner ring support structure 40 which is generally L-shaped in cross-section (see FIG. 2) and includes a generally cylindrical base 42 and a radially outward extending disc portion 44. Secured to the disc portion 44 is an angled ring member 50 which includes an array of radially extending cut-outs 52 so as to define a generally scalloped configuration, as viewed from the rear of the assembly 10 (see FIG. 3). The angled cross-section of the ring 50 (see FIGS. 2 and 4) results in a circumferential space or slot 60 extending about the radially outer diameter of the disc portion 44 of the ring support structure 40. As illustrated, the circumferential slot 60 is downstream of the disc portion 44.

The leg portions 36 of the T-shaped lugs 34 are respectively slidably mounted in the cut-outs 52, while the transverse bar segment 38 of each lug 34 is slidably mounted in the space 60 defined between the disc 44 and the angled ring 50 (see FIGS. 2 and 4). By this arrangement, a slip fit interconnection is defined between each segment 32 and the inner ring support structure 40, with the slip fit connection effectively maintaining the continuity between the segmented ring 30 and the inner support ring 40 so as to define a pressure dam for minimizing pressure leakage through the flexible coupling of the supporting and sealing structure. It is noted that the pressure dam is maintained throughout the various transient and steady state operating conditions of the gas turbine engine, during which time the thermal excursions of the vanes cause the segments 32 to move relative to the inner support ring 40.

Disposed at the upstream end of each segment 32 and extending between said segment 32 and the upstream end of the base 42 is a spring means in the form of a C-shaped, flexible spring 70. As shown in FIG. 1, a plurality of springs 70 are provided preferably corresponding to the number of segments 32 of the segmented ring 30. Each spring 70 is connected at its opposite ends to a segment 32 and to the base 42 of the inner support ring 40. By this arrangement the springs 70 provide a constant biasing force for maintaining the guide vanes 16 in axial and radial alignment during both transient and steady state operating conditions of the gas turbine engine when the stationary vane assembly 10 and the components thereof are subjected to thermal excursions. Accordingly, the arrangement of springs 70, segmented ring 30, and the inner ring support 40 effectively defines a flexible coupling as part of the supporting and sealing structure of the subject invention. Furthermore, axial positioning of the guide vanes 16 is assured by virtue of the slip fit interconnection between the T-shaped lugs 34 and the inner ring support structure 40, and in particular, the interconnection between the transverse bar segments 38 of the lugs 34 and the circumferential slot 60 defined between the disc 44 and angled ring 50.

In operation, the supporting and sealing structure 30 insures that the required sealing of the pressure upstream of the vane assembly is maintained relative to the differential pressure downstream of the vane assembly, and by virtue of the flexible coupling interconnection, differential thermal expansion and excursions of the shrouds and the guide vanes is readily accommodated without the development of local stresses which could lead to cracks in the assembly 10.

Accordingly, the subject invention provides a partially segmented turbine nozzle having a flexible support and sealing inner shroud member which is effective to accommodate and neutralize thermal excursions of components of the nozzle during transient and steady state operating conditions of the gas turbine engine. The flexible coupling at the inner shroud of the subject nozzle assembly insures that the structural integrity of the fixed, usually brazed, connections of the vane tips to the outer shroud is maintained. Furthermore, the subject construction eliminates local stress problems brought about by differential thermal expansions of the components of the assembly. Flexibility of the subject turbine nozzle is achieved by the arrangement of segmenting the inner shroud and the provision of the springs which maintain the radial positions of the inner ring structure 40, while providing flexibility of the guide vanes in the radial direction. The pressure dam forming a portion of the supporting and sealing inner shroud construction is effective to reduce leakage through the segmented inner shroud, and the pressure dam includes the slip fit construction so as to maintain the pressure dam during various operating conditions of the gas turbine engine, while enabling free movement of the guide vanes in the radial direction. Still further, the specific construction of the pressure dam of the subject invention functions to maintain and locate the axial position of the segmented ring, and the slip fit construction further aids in maintaining concentricity of the inner shroud.

Although the invention has been described with respect to a preferred embodiment, it is readily apparent that those skilled in the art will be able to make numerous modifications of the exemplary embodiments without departing from the spirit and scope of the invention. All such modifications are intended to be included within the spirit and scope of the invention as defined by the appended claims.

We claim:

1. In a nozzle assembly for a gas turbine engine including a shroud ring and a support ring, said support ring being coaxially aligned and radially displaced within said shroud ring and a plurality of vanes extending radially between said rings, each of said vanes being fixed at its outer end to the shroud ring and being flexibly and slidably mounted at its inner end by the support ring, said support ring comprising:

an inner base structure having a generally L-shaped cross-section including a cylindrical base and a radially outward extending disc; said disc having an annular radially extending slot constructed therein;

a segmented ring positioned radially outward of said inner base structure and defined by a plurality of segments each of which is respectively connected to the inner end of each vane, each of said ring segments having a radially inward extending flange which is slidably engaged within the annular slot of the radially outward extending disc of the inner base structure to retain the vane in radial alignment and to define a pressure dam to minimize leakage through the support ring; and a spring member having a substantially C-shaped cross-section connected between said cylindrical base of said base structure and the segmented ring and axially displaced from the outward extending disc whereby said inner support ring defines a flexible connection at the inner end of each vane structure which accommodates radial excursions, while including a biasing force for maintaining the nozzle assembly in axial and radial alignment.

* * * * *